US011982077B2

(12) United States Patent
Keizers

(10) Patent No.: US 11,982,077 B2
(45) Date of Patent: May 14, 2024

(54) COMBINATION OF A DRAIN, SUCH AS AN OUTLET DRAIN OR SHOWER DRAIN, AND A SEAL

(71) Applicant: Easy Sanitary Solutions B.V., Oldenzaal (NL)

(72) Inventor: Jurgen Hendrik Peter Joseph Keizers, Oldenzaal (NL)

(73) Assignee: Easy Sanitary Solutions B.V., Oldenzaal (NL)

( * ) Notice: Subject to any disclaimer, the term of this patent is extended or adjusted under 35 U.S.C. 154(b) by 172 days.

(21) Appl. No.: 17/609,851

(22) PCT Filed: May 14, 2020

(86) PCT No.: PCT/NL2020/050311
§ 371 (c)(1),
(2) Date: Nov. 9, 2021

(87) PCT Pub. No.: WO2020/231262
PCT Pub. Date: Nov. 19, 2020

(65) Prior Publication Data

US 2022/0220719 A1 Jul. 14, 2022

(30) Foreign Application Priority Data

May 14, 2019 (NL) ..... 2023130

(51) Int. Cl.
*E03F 5/04* (2006.01)

(52) U.S. Cl.
CPC ..... *E03F 5/0408* (2013.01); *E03F 5/0409* (2013.01)

(58) Field of Classification Search
CPC ..... E03F 5/0408; E03F 5/0409
USPC ... 4/650, 619, 443, 445, 446, 507, 515, 519, 4/538, 631, 643, 663, 665, 671, 675, 679; 68/3, 232; 108/4; 454/339; 134/1, 43; 114/188
See application file for complete search history.

(56) References Cited

U.S. PATENT DOCUMENTS

| | | | |
|---|---|---|---|
| 2,239,969 | A | 4/1941 | Morthland |
| 5,845,347 | A | 12/1998 | Young |
| 10,292,539 | B2 | 5/2019 | Schindler |

(Continued)

FOREIGN PATENT DOCUMENTS

| | | | |
|---|---|---|---|
| DE | 202010003239 | U1 | 8/2010 |
| DE | 202019001142 | U1 | 5/2019 |
| EP | 2085528 | A1 | 8/2009 |

(Continued)

*Primary Examiner* — Lori L Baker
(74) *Attorney, Agent, or Firm* — The Webb Law Firm

(57) ABSTRACT

The invention relates to a device for arranging a seal on a collecting tray of a drain, such as an outlet drain or shower drain, which device includes: a fixing plate for fixing under a collecting tray of a drain, which fixing plate has at least two straight edges lying at an acute angle, preferably an angle of 90 degrees. The fixing plate includes at least one fastening opening through which a fastening means such as a threaded end and nut can protrude for the purpose of fastening the fixing plate against a bottom of a collecting tray and a watertight, flexible membrane which is arranged with an edge zone on the fixing plate. The free part of the membrane is upright and extends substantially perpendicularly of the fixing plate.

16 Claims, 3 Drawing Sheets

(56) References Cited

U.S. PATENT DOCUMENTS

2019/0191932 A1 6/2019 Costello

FOREIGN PATENT DOCUMENTS

| | | | | | |
|---|---|---|---|---|---|
| EP | 2248956 | A1 | | 11/2010 | |
| EP | 2423395 | A1 | | 2/2012 | |
| EP | 2466023 | A1 | | 6/2012 | |
| EP | 2669442 | A1 | | 12/2013 | |
| EP | 3150093 | A1 | | 4/2017 | |
| EP | 3243970 | A1 | * | 11/2017 | ..... E03F 5/0408 |
| EP | 3298938 | A1 | | 3/2018 | |
| EP | 3686363 | A1 | * | 7/2020 | |
| GB | 2553352 | A | * | 3/2018 | ..... A47K 1/14 |

* cited by examiner

COMBINATION OF A DRAIN, SUCH AS AN OUTLET DRAIN OR SHOWER DRAIN, AND A SEAL

CROSS-REFERENCE TO RELATED APPLICATIONS

This application is the United States national phase of International Application No. PCT/NL2020/050311 filed May 14, 2020, and claims priority to The Netherlands Patent Application No. 2023130 filed May 14, 2019, the disclosures of which are hereby incorporated by reference in their entirety.

BACKGROUND OF THE INVENTION

Field of the Invention

The invention relates to a combination of a drain, such as an outlet drain or shower drain, and a seal.

Description of Related Art

EP 2669442 for instance describes a collecting tray of a shower drain, wherein the collecting tray has a bottom with an outflow opening and an upright peripheral wall arranged along the periphery of the bottom. A flat plate is mounted against the underside of the bottom of the collecting tray, around the outflow opening. The flat plate protrudes relative to the peripheral wall, so that a flange can be formed to which a watertight, flexible membrane can be adhered.

When arranging a drain in a floor, it is necessary to make both the floor and the connecting walls watertight by arranging flexible watertight layers on which a finishing layer, such as a tile layer, can then be arranged. It is difficult to obtain a good seal particularly in a corner of floor and connecting walls lying at right angles to each other, because surfaces converge from three directions.

In the case of a collecting tray as according to EP 2669442 it is possible to fold the membrane, which is arranged flat, so that it takes on the shape of such a corner. The drawback of folding is that the membrane must be folded double, whereby variations in thickness are formed which are difficult to incorporate in a finishing layer.

Forming a corner piece from individual parts in order to obtain a corner piece without thickened portions will usually result in a construction that is not watertight because it is not possible to form a good seal at the position where the bottom surface and the two side surfaces converge. Providing a mastic layer at the transitions between the individual parts does not provide a reliable seal either.

Further known are corner pieces preformed from a flexible watertight layer, for instance under the brand name Schlüter Kerdi Kereck. Such preformed corner pieces can be glued in a corner of an element and walls during construction. Further widths of watertight layers can then be arranged overlapping the corner piece.

In order to obtain a reliable seal when processing such a preformed corner piece during construction an adhesive edge of at least 5 centimetres in width is required. Such a wide edge is necessary because dust and fouling on the adhesive surfaces will be difficult to prevent on a building site.

In addition, an adhesive edge of at least 5 centimetres is not always available. When a collecting tray of an elongate shower drain is for instance placed against a wall of a bathroom, a connecting flange of about 2 centimetres is all that's available on the collecting tray. This is because it is desirable to have the inflow opening connect to the wall tiles, which are usually about 2 centimetres thick, including an adhesive layer.

It is possible to adhere the corner piece to the element in a production environment, where dust and fouling can be prevented. In such a production environment an adhesive edge of 2 centimetres more than suffices for a reliable adhesion of the corner piece to the element.

The drawback of arranging a corner piece or flat membrane on a collecting tray of a drain in a production environment is that collecting trays with such a form must be kept in stock, in addition to the same variant without corner piece or flat membrane.

It is also undesirable to arrange a corner piece on a flat plate which extends around the outflow opening of the collecting tray. When the collecting tray is arranged between two corners, corner pieces would have to be arranged on both ends of the flat plate, while, when arranged against a single corner, the plate need only be provided with one corner piece, this also bringing with it the choice between a left-hand and a right-hand variant.

Finally, the positioning of a flat plate with opening for the outflow opening of the collecting tray is determined by the outflow opening. It is therefore not possible to make a lot of adjustments and variations.

SUMMARY OF THE INVENTION

It is now an object of the invention to reduce or even obviate the above stated drawbacks.

This object is achieved with a combination of a drain, such as an outlet drain or shower drain, and a seal, wherein the drain has an inflow opening arranged on the upper side, wherein the seal is arranged against the underside of the drain and wherein the seal extends upward from the underside, along and beyond the upper side, at a corner and along the periphery of the drain, such that an upright free strip is formed.

With the combination according to the invention the drain can be provided entirely as desired with a seal by arranging the seal against the underside of the drain. Now that almost the whole underside of the drain can be used as fixing surface, there will be sufficient surface area for a reliable seal. An adhesive edge of 5 centimetres or more can thus be provided on the underside in simple manner, while the most minimal possible flange or edge can be provided on the upper side.

In an embodiment of the combination according to the invention the seal further comprises:

- a fixing plate against the underside of the drain, which fixing plate has at least two straight edges lying at an acute angle, preferably an angle of 90 degrees, and wherein the fixing plate comprises at least one fastening opening through which a fastening means such as a threaded end and nut can protrude for the purpose of fastening the fixing plate against a bottom of a collecting tray;
- a watertight, flexible membrane which is arranged with an edge zone on the fixing plate, wherein the free part of the membrane extends upward from the underside of the drain, along and beyond the upper side of the drain, such that an upright free strip is formed.

With the fixing plate the corner piece can be installed easily against the underside of the drain. The watertight, flexible membrane extends upward, whereby it can lie flush and without folds against the walls of a corner in a space, and can seal them.

Such a device can moreover be arranged on every corner of the drain, and two devices can for instance be installed when the drain is placed between two corners.

In a preferred embodiment of the device according to the invention an upright wall is arranged on the fixing plate, along the two straight edges, wherein a flange is arranged on the upper edge of the upright wall and wherein the flange is parallel to the fixing surface.

Such an embodiment is particularly suitable for installation on a drain, which is provided on the upper edge with a peripheral flange. The device will follow the contours of the drain with peripheral flange with its upright wall and flange so that the watertight, flexible membrane will run upward along the peripheral flange of the drain and can thus lie against the walls forming the corner.

The edge zone of the watertight, flexible membrane is preferably adhered to the flange.

In a further preferred embodiment of the combination according to the invention the watertight, flexible membrane is preformed into an element with two surfaces at right angles to each other and a flange formed at right angles to these surfaces, such that the element has an L-shaped cross-section as seen in the direction at right angles to the intersection of the surfaces.

Such a preformed element can be adhered to the fixing plate in reliable manner in a production environment. With the fixing plate a suitable drain can then be provided with a corner piece from watertight, flexible membrane in simple and reliable manner on a building site.

In another embodiment of a combination according to the invention a depending wall is arranged on the free edge of the flange, and the edge zone of the watertight, flexible membrane is adhered to the depending wall.

In such an embodiment no preformed element is necessary, and a strip of watertight, flexible membrane can be arranged on the depending wall in simple manner, thus forming an upright part of the membrane.

By arranging fastening means at suitable positions on the underside of the bottom a plumber can arrange a device according to the invention at the desired positions during installation of the collecting tray. The fastening opening preferably takes a form, for instance elongate, such that the device can be adjusted relative to the collecting tray.

In a further embodiment of the combination according to the invention an adhesive layer is arranged between the seal and the underside of the drain. This adhesive layer provides for a reliable sealing between the seal and the drain. Other ways of sealing are also possible, for instance arranging a foam layer between the underside and the seal.

In yet another embodiment of a combination according to the invention the watertight, flexible membrane of the seal extends along the upright wall of the drain and to a position beyond the upper edge of the upright wall.

In yet another embodiment of the combination according to the invention the seal is a watertight, flexible membrane, such as a tile membrane, which seal comprises at least a fixing surface with at least two straight edges lying at an acute angle, preferably an angle of 90 degrees, and surfaces standing upright along the at least two straight edges.

A stepped part can optionally be arranged in the upright surfaces. In this embodiment the sealing membrane can follow the contours of a usual drain, which is provided with a bottom, upright walls and a horizontal flange.

In yet another embodiment of the combination according to the invention the drain is a flat plate, which flat plate is provided with an opening which forms the inflow opening on the upper side and forms an outlet opening on the underside of the flat plate.

Because the seal is always fixed on the underside, the upper side can remain free and for instance be visible. With a flat plate, over part of which lies a surrounding tile floor, as described in EP 2466023, a reliable seal can thus still be formed during installation.

Yet another embodiment of the combination according to the invention further comprises a second watertight, flexible membrane which is arranged on the upper side of the drain, wherein the second watertight, flexible membrane comprises an opening which corresponds with the inflow opening of the drain.

In this embodiment an already existing drain, which is provided on the upper side with a sealing membrane, can be combined with the seal according to the invention. When installed against a wall, a suitable part can be removed from the second watertight, flexible membrane and then be arranged, overlapping the seal, against the wall.

BRIEF DESCRIPTION OF THE DRAWINGS

These and other features of the invention are further elucidated with reference to the accompanying drawings.

DESCRIPTION OF THE INVENTION

Figure 1:
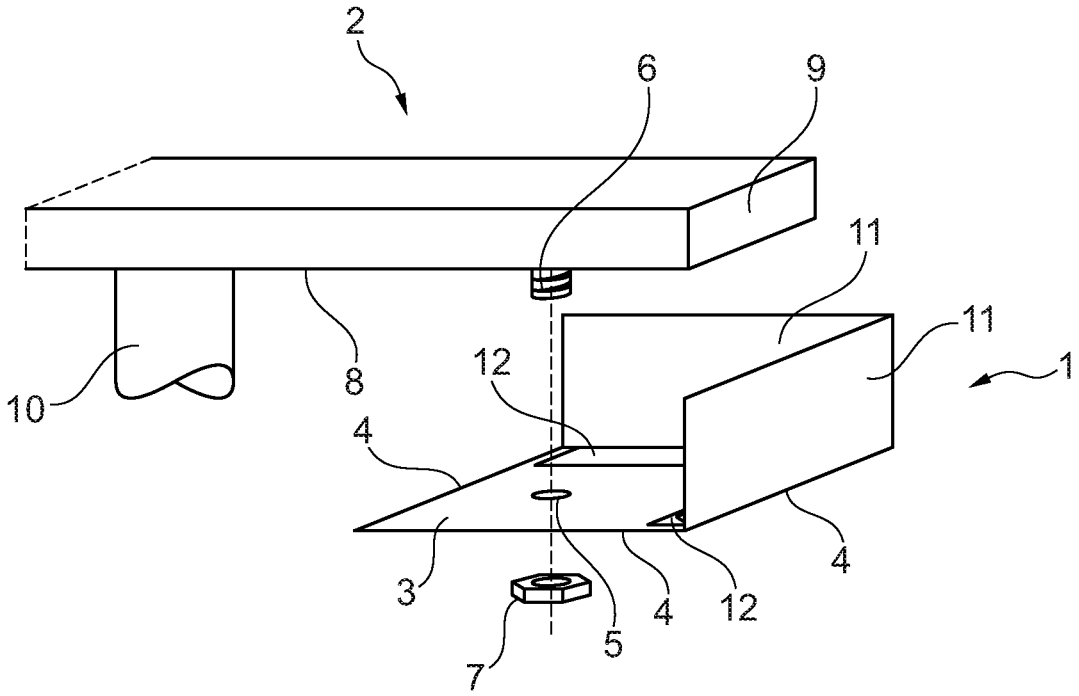
FIG. 1 shows a first embodiment of a combination according to the invention with exploded parts.

FIG. 1 shows a device 1 and a collecting tray 2 according to the invention. Device 1 has a fixing plate 3 with four straight edges 4. Arranged in the fixing plate 3 is a fastening opening 5 through which a threaded end 6 protrudes in installed state, onto which threaded end a nut 7 is tightened.

Threaded end 6 is arranged on the underside 8 of the bottom of collecting tray 2. An upright wall 9 is provided along the peripheral edge of this bottom 8 and an outflow 10 is provided in bottom 8.

A preformed membrane 11, 12 is arranged on fixing plate 3 along two straight edges 4. This preformed membrane 11, 12 is embodied with an edge zone 12, which is adhered to fixing plate 3, and an upright part 11.

Figure 2:
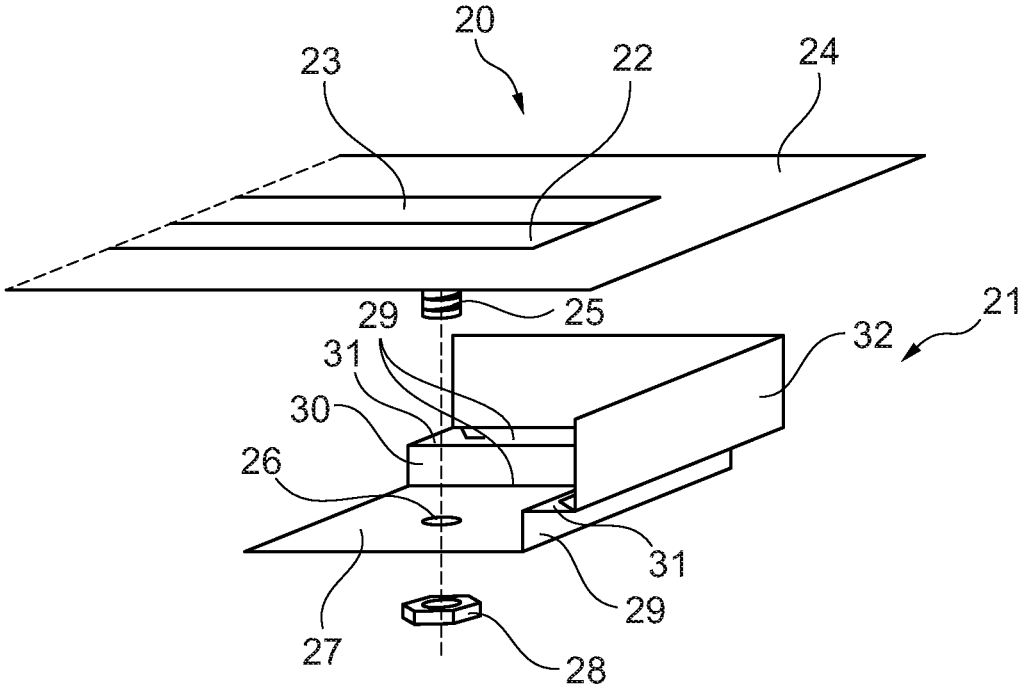
FIG. 2 shows a second embodiment of a combination according to the invention with exploded parts.

FIG. 2 shows a second embodiment of a collecting tray 20 and a device 21 according to the invention. Collecting tray 20 has a bottom 22 with a wall 23 standing upright along the periphery and a peripheral flange 24 which is arranged on the upper edge and is parallel to bottom 22.

Arranged on the underside of bottom 22 is a threaded end 25 which protrudes through a fastening opening 26 in a fixing plate 27 of device 21. A nut 28 is tightened onto threaded end 25 in order to fixedly clamp fixing plate 27 against bottom 23.

Arranged along two edges 29, lying at right angles, of fixing plate 27 are upright walls 30 on which a horizontal flange 31 is arranged. A preformed membrane 32 with an L-shaped cross-section is adhered to this flange 31.

Figure 3:
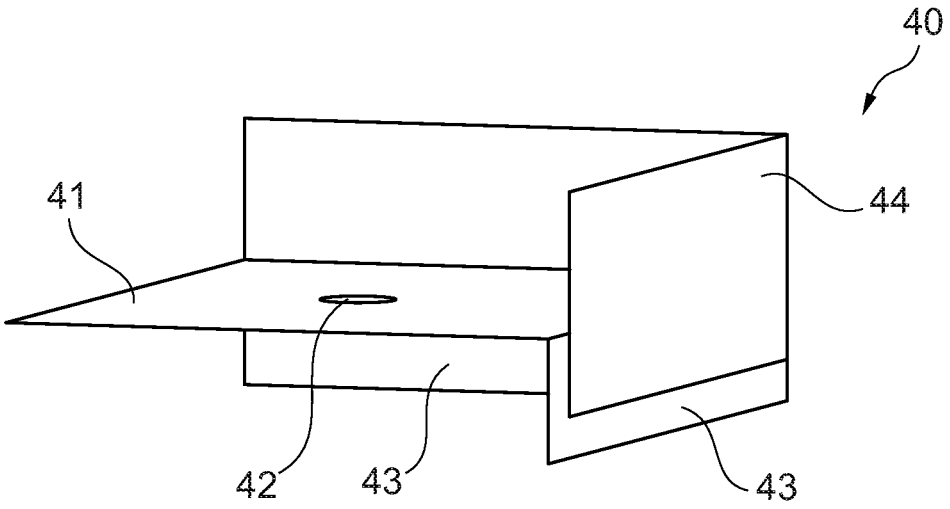
FIG. 3 shows a third embodiment of a device according to the invention in perspective view.

FIG. 3 shows a third embodiment of a device 40 according to the invention. Device 40 has a fixing plate 41 with a fastening opening 42. Provided along two straight edges of the fixing plate 41 are depending walls 43 on which a strip of watertight, flexible membrane 44 is arranged. The upper side of this membrane 44 lies clear and can be adhered to a wall of a space.

Figure 4:
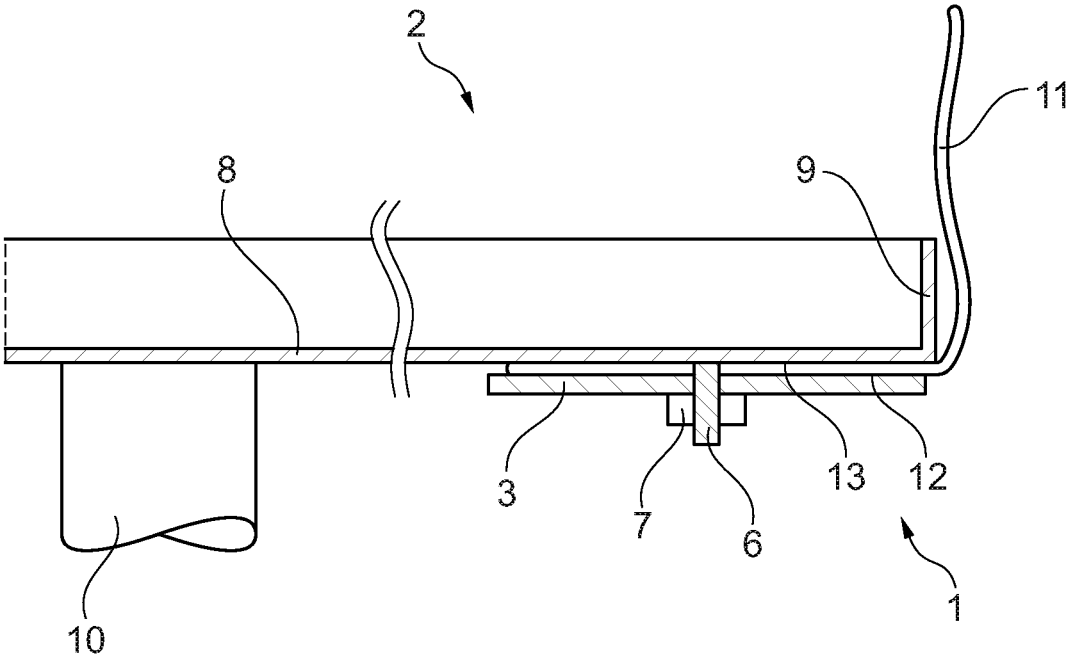
FIG. 4 shows a cross-sectional view of the embodiment according to FIG. 1.

FIG. 4 shows the embodiment 1, 2 according to FIG. 1 in installed state. An adhesive layer 13, such as a sealant, is arranged between bottom 8 of collecting tray 2 and fixing plate 3 of device 2. Fixing plate 3 is clamped firmly against sealant 13 and bottom 8 by means of the nut 7, whereby a good and reliable fixing of the watertight, flexible membrane 11, 12 is obtained.

Figure 5:
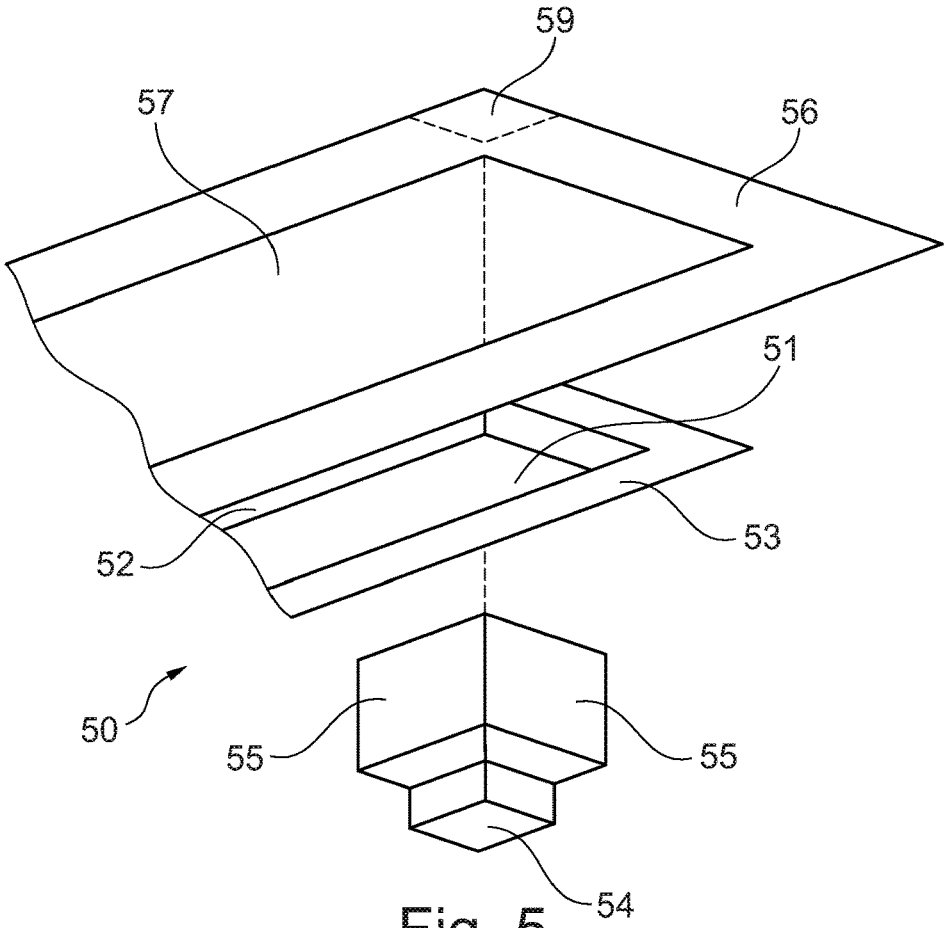
FIGS. 5 and 6 show a fourth embodiment of a combination according to the invention.

FIG. 5 shows a fourth embodiment 50 of a combination according to the invention. Combination 50 has a drain (partially shown) with a bottom 51, upright wall 52 along the periphery of bottom 51 and a horizontal peripheral flange 53.

Arranged against the underside of bottom 51 is a seal with a fixing surface 54 with upright surfaces 55 which are arranged along two straight edges and in which a stepped part is arranged.

A second flexible, watertight membrane 56 is arranged against the upper side of drain 51, 52, 53. Provided in this membrane 56 is an opening 57 which corresponds with the inflow opening surrounded by the upright wall 52 of drain 51, 52, 53.

Figure 6:
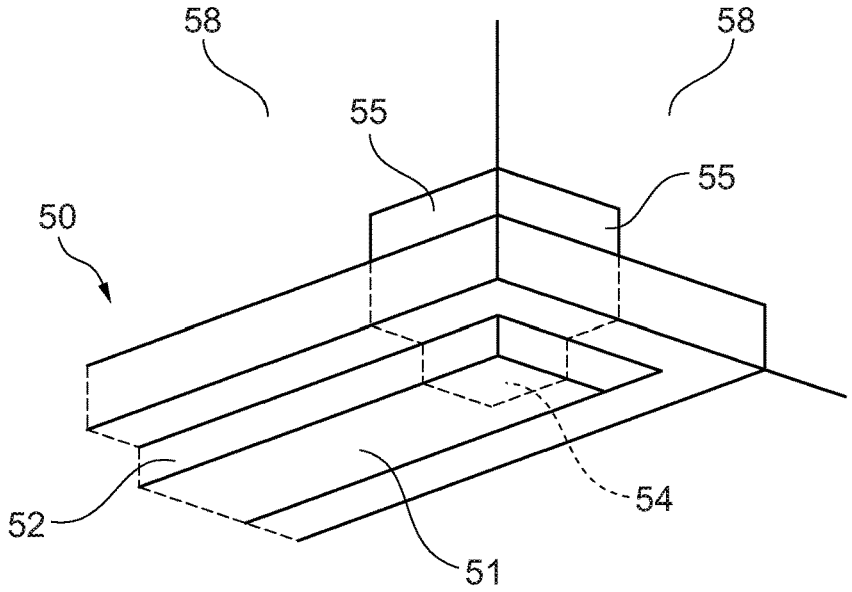

FIG. 6 shows the combination 50 installed against two walls 58. Seal 54, 55 is arranged against the underside of bottom 51 of the drain and the second watertight, flexible membrane 56 is fixed to the horizontal flange 53.

A corner 59 has been removed from this second membrane 56 so that the longitudinal edges of membrane 56 can be folded and can be arranged, overlapping the upright surfaces 55, against walls 58.

The invention claimed is:

1. A combination of a drain and a seal, wherein the drain has an upper side, an underside, a corner, a periphery, and an inflow opening arranged on the upper side, wherein the seal is arranged against the underside of the drain and wherein the seal extends upward from the underside, along and beyond the upper side, at the corner and along the periphery of the drain, such that an upright free strip is formed, wherein the seal further comprises: a fixing plate against the underside of the drain, which fixing plate has at least two straight edges lying at an acute angle or at an angle of 90 degrees, and wherein the fixing plate comprises at least one fastening opening through which a fastening element of the drain protrudes for the purpose of fastening the fixing plate against a bottom of a collecting tray; and a watertight, flexible membrane which is arranged with an edge zone on the fixing plate, wherein the free part of the membrane extends upward from the underside of the drain, along and beyond the upper side of the drain, such that an upright free strip is formed.

2. The combination according to claim 1, wherein an upright wall is arranged on the fixing plate, along the two straight edges, wherein a flange is arranged on the upper edge of the upright wall and wherein the flange is parallel to the fixing surface.

3. The combination according to claim 2, wherein the edge zone of the watertight, flexible membrane is adhered to the flange.

4. The combination according to claim 1, wherein the watertight, flexible membrane is preformed into an element with two surfaces at right angles to each other and a flange formed at right angles to these surfaces, such that the element has an L-shaped cross-section as seen in the direction at right angles to the intersection of the surfaces.

5. The combination according to claim 2, wherein a downwardly extending wall is arranged on the free edge of the flange and wherein the edge zone of the watertight, flexible membrane is adhered to the downwardly extending wall.

6. The combination according to claim 1, wherein an adhesive layer is arranged between the seal and the underside of the drain.

7. The combination according to claim 1, wherein the drain is a flat plate, which flat plate is provided with an opening which forms the inflow opening on the upper side and forms an outlet opening on the underside of the flat plate.

8. The combination according to claim 1, further comprising a second watertight, flexible membrane which is arranged on the upper side of the drain, wherein the second watertight, flexible membrane comprises an opening which corresponds with the inflow opening of the drain.

9. A combination of a drain and a seal, wherein the drain has an upper side, an underside, a corner, a periphery, and an inflow opening arranged on the upper side, wherein the seal is arranged against the underside of the drain and wherein the seal extends upward from the underside, along and beyond the upper side, at the corner and along the periphery of the drain, such that an upright free strip is formed, further comprising a second watertight, flexible membrane which is arranged on the upper side of the drain, wherein the second watertight, flexible membrane comprises an opening which corresponds with the inflow opening of the drain.

10. The combination according to claim 9, wherein the seal further comprises: a fixing plate against the underside of the drain, which fixing plate has at least two straight edges lying at an acute angle or at an angle of 90 degrees, and wherein the fixing plate comprises at least one fastening opening through which a fastening element of the drain protrudes for the purpose of fastening the fixing plate against a bottom of a collecting tray; and a watertight, flexible membrane which is arranged with an edge zone on the fixing plate, wherein the free part of the membrane extends upward from the underside of the drain, along and beyond the upper side of the drain, such that an upright free strip is formed.

11. The combination according to claim 9, wherein an upright wall is arranged on the fixing plate, along the two straight edges, wherein a flange is arranged on the upper edge of the upright wall and wherein the flange is parallel to the fixing surface.

12. The combination according to claim 11, wherein the edge zone of the watertight, flexible membrane is adhered to the flange.

13. The combination according to claim 9, wherein the watertight, flexible membrane is preformed into an element with two surfaces at right angles to each other and a flange formed at right angles to these surfaces, such that the element has an L-shaped cross-section as seen in the direction at right angles to the intersection of the surfaces.

14. The combination according to claim 11, wherein a downwardly extending wall is arranged on the free edge of the flange and wherein the edge zone of the watertight, flexible membrane is adhered to the downwardly extending wall.

15. The combination according to claim 9, wherein an adhesive layer is arranged between the seal and the underside of the drain.

16. The combination according to claim 9, wherein the drain is a flat plate, which flat plate is provided with an opening which forms the inflow opening on the upper side and forms an outlet opening on the underside of the flat plate.

* * * * *